US009303441B2

(12) United States Patent
Bravo et al.

(10) Patent No.: US 9,303,441 B2
(45) Date of Patent: Apr. 5, 2016

(54) ACCESS DOOR WITH LIFT ASSIST

(71) Applicant: U.S.F. Fabrication, Inc., Hialeah, FL (US)

(72) Inventors: Andres Bravo, Sunrise, FL (US); Wolters Acosta, Hialeah, FL (US); Marvin Ernesto Lopez, Miami, FL (US)

(73) Assignee: U.S.F. Fabrication, Inc., Hialeah, FL (US)

( * ) Notice: Subject to any disclaimer, the term of this patent is extended or adjusted under 35 U.S.C. 154(b) by 3 days.

(21) Appl. No.: 14/180,693

(22) Filed: Feb. 14, 2014

(65) Prior Publication Data

US 2015/0218773 A1 Aug. 6, 2015

Related U.S. Application Data

(60) Provisional application No. 61/934,261, filed on Jan. 31, 2014.

(51) Int. Cl.
*E05F 1/00* (2006.01)
*E05F 1/10* (2006.01)

(52) U.S. Cl.
CPC ..... *E05F 1/1058* (2013.01); *E05Y 2900/612* (2013.01)

(58) Field of Classification Search
CPC ..... E02D 29/1418; E06B 5/01; E06B 5/02; E05F 1/10; E05F 1/1041
USPC ..... 49/386, 387, 388, 399, 400, 394; 16/72, 16/286
See application file for complete search history.

(56) References Cited

U.S. PATENT DOCUMENTS

| | | | | |
|---|---|---|---|---|
| 20,679 | A | 6/1858 | Brown | |
| 1,195,965 | A | 10/1877 | Straight | |
| 2,249,403 | A | 7/1941 | Stollsteimer | |
| 4,133,074 | A | 1/1979 | Schack | |
| 4,163,344 | A | 8/1979 | Scherer | |
| 4,534,132 | A * | 8/1985 | Smith | 49/386 |
| 4,535,908 | A | 8/1985 | Dabich | |
| 5,029,362 | A | 7/1991 | Prodan | |
| 5,076,188 | A | 12/1991 | Burroughs | |
| 5,205,073 | A | 4/1993 | Lyons, Sr. | |
| 5,324,135 | A | 6/1994 | Smith | |
| 6,021,606 | A * | 2/2000 | Kos | 49/386 |
| 6,041,553 | A | 3/2000 | Joyce et al. | |
| 6,718,692 | B2 * | 4/2004 | Mc Kernan | 49/67 |
| 7,216,459 | B1 * | 5/2007 | Akkala et al. | 52/20 |
| 8,166,706 | B2 | 5/2012 | Slimak et al. | |
| 2008/0016780 | A1 * | 1/2008 | McDougle et al. | 49/387 |
| 2011/0222964 | A1 * | 9/2011 | Lacroix | 404/26 |

FOREIGN PATENT DOCUMENTS

| | | | | |
|---|---|---|---|---|
| FR | 2907143 | * | 1/2006 | |
| JP | 06104579 A | * | 4/1994 | H05K 5/03 |
| WO | WO 2012123672 A2 | * | 9/2012 | |

* cited by examiner

*Primary Examiner* — Jerry Redman
(74) *Attorney, Agent, or Firm* — GrayRobinson, P.A.; Michael J. Colitz, III

(57) ABSTRACT

The invention described herein relates to a utility vault door, or access door, positionable between closed, partially opened, and fully opened orientations and including at least one compression spring lift-assist mechanism for countering the weight of the vault door when positioning between the various orientations. The door may be selectively locked in the partially opened orientation and opened sufficiently for the convenient ingress and egress of large equipment therethrough.

16 Claims, 10 Drawing Sheets

ACCESS DOOR WITH LIFT ASSIST

RELATED APPLICATION DATA

This application claims priority to co-pending Provisional Application Ser. No. 61/934,261 filed on Jan. 31, 2014 and entitled "Access Door with Lift Assist." The content of this application is fully incorporated by reference herein for all purposes.

TECHNICAL FIELD

This disclosure relates to a vault door. More particularly the invention relates to a vault door that is selectively positionable between closed, partially opened, and fully opened orientations and includes a series of lift-assist mechanisms for ease of opening and closing from any orientation.

BACKGROUND OF THE INVENTION

The use of access doors is known in the prior art. These doors are often mounted within the ground and control access to underground utilities. However, existing doors often have several disadvantageous limitations. For example, because access doors have to be strong enough to prevent unauthorized access as well as to withstand vehicle traffic, they are traditionally heavy and cumbersome. Further, the weight of an access door often makes it difficult to permit opening by a single user.

Access doors must also be capable of opening wide enough to accommodate ingress and egress of large equipment. However, most doors are not adapted to be held open on their own or designed to achieve a fully-opened orientation.

Thus, a need exists in the art for a vault door that is sufficiently strong and that provides a large enough opening for equipment but that is easy to open without undue strain or force. The vault door of the present disclosure is aimed at overcoming this and other needs in the art.

SUMMARY OF THE INVENTION

The invention described herein relates to a utility vault door, or access door, positionable between closed, partially opened, and fully opened orientations and including at least one compression spring lift-assist mechanism for countering the weight of the vault door when positioning between the various orientations.

The invention disclosed herein has several important advantages. For example, this disclosure provides an access door with two discrete opened orientations.

Another advantage of the present disclosure includes providing an access door that can be locked in a partially opened orientation.

Yet another advantage of the present disclosure includes providing an access door with at least one compression spring lift-assist mechanism for overcoming the weight of the door and thereby easing the positioning of the door between a plurality of orientations.

Still yet another advantage of the present disclosure includes providing primary and secondary compression spring lift-assist mechanisms for overcoming the weight of the door and thereby easing the positioning of the door between a plurality of orientations.

Another advantage of the present disclosure includes providing a means to obstruct a floor opening with a frame and cover assembly that allows for the complete 180 degree rotation of the door from the open to closed positions, with the operation complimented in both directions with compression lift assist devices.

Yet another advantage of the present disclosure includes providing at least one lift-assist in which no more than 30 pounds of lift is required at any point in the 180 degree arc of the opening door, thereby allowing for safer and more ergonomic operation of the door.

Another advantage is realized by providing a first set of lift-assist mechanisms for assisting with the movement of the door between the 0 to 90 degree positions, and by providing a second set of lift-assist mechanisms for assisting the movement of the door between the 90 to 180 degree positions.

Still yet another advantage of the present invention includes providing a door with lift assistance when positioning between the 180 degree and 90 degree orientations.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present disclosure and its advantages, reference is now made to the following descriptions, taken in conjunction with the accompanying drawings, in which.

Similar reference numerals refer to similar parts throughout the several views of the drawings.

PARTS LIST

| | |
|---|---|
| 10 | ground mounted vault closure |
| 12 | rectangular frame |
| 14 | anchor members |
| 16 | latch receiver |
| 18 | locking pin receiver |
| 20 | ground |
| 22 | vault door |
| 24 | plurality of reinforcing ribs |
| 26 | primary apertured compression plate |
| 28 | secondary apertured compression plate |
| 34 | interior handle |
| 36 | slide formed within peripheral edge |
| 38 | first locking detent |
| 39 | second locking detent |
| 40 | stowable exterior lifting handles |
| 42 | male latch |
| 44 | hold-open arm |
| 46 | first end of hold-open arm |
| 48 | second end of hold-open arm |
| 50 | primary lift assist mechanisms |
| 52 | pivotal hinge |
| 54 | first end of pivotal hinge |
| 56 | second end of pivotal hinge |
| 58 | first compression spring |
| 60 | second compression spring |
| 62 | first end of first compression spring |
| 63 | first end of second compression spring |
| 64 | second end of first compression spring |
| 65 | second end of second compression spring |
| 66 | first support rod |
| 68 | first end of first support rod |
| 70 | second end of first support rod |
| 72 | primary compression washer |
| 74 | secondary lift assist mechanism |
| 76 | connector hinge |
| 78 | first end of the connector hinge |
| 80 | second end of the connector hinge |
| 82 | third spring |
| 81 | second support rod |
| 86 | first end of third spring |
| 88 | second end of third spring |
| 90 | first end of second support rod |
| 92 | second end of second support rod |
| 94 | secondary compression washer |
| 95 | end cap |
| 96 | hinge plate |
| 98 | first end of hinge plate |
| 100 | second end of hinge plate |
| 102 | aperture in hinge plate |
| 104 | locking pin |

DETAILED DESCRIPTION OF EMBODIMENTS

The present invention relates to a vault door. More particularly the invention relates to a vault door that is selectively positionable between closed, partially opened, and fully opened orientations and includes a series of compression spring lift-assist mechanisms for ease of opening and closing. The various components of the present invention, and the manner in which they interrelate, are described in greater detail hereinafter.

Figure 1:
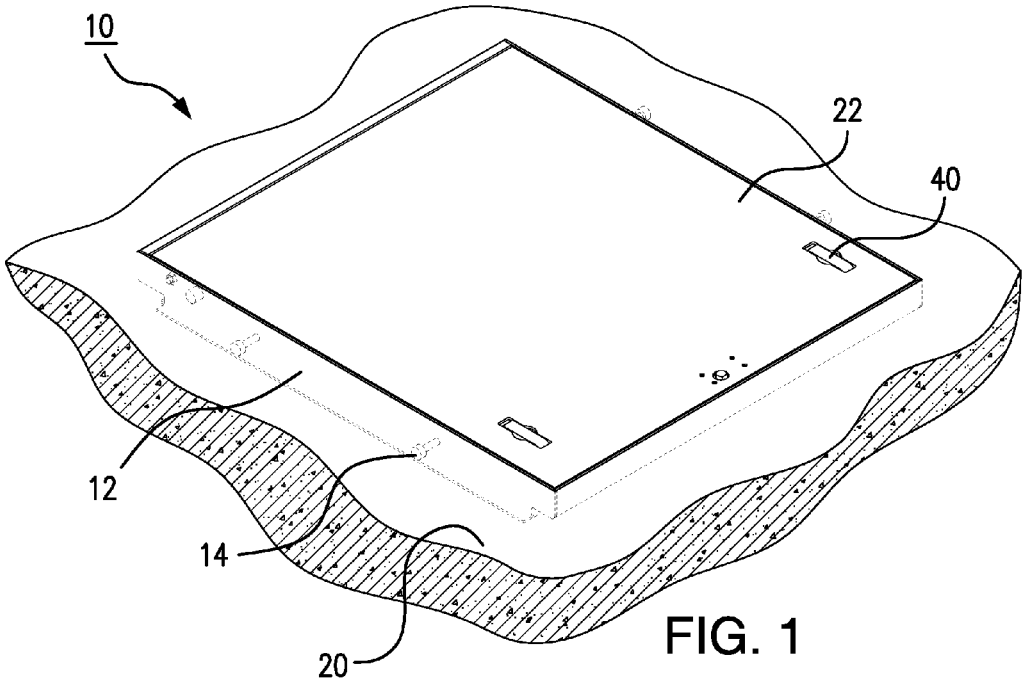
FIG. 1 is a perspective view of the vault door in the closed orientation.
Figure 2:
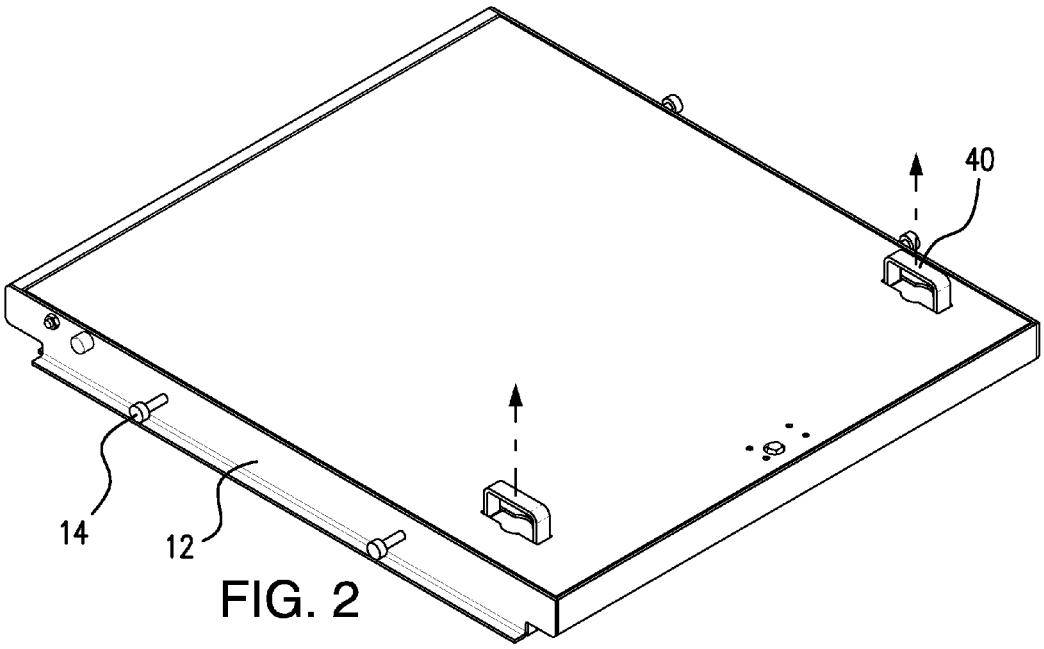
FIG. 2 is a perspective view of the vault door showing the peripheral edge.

Initially with reference to FIGS. 1 and 2, the invention provided herein includes a ground mounted vault closure 10 selectively positionable between closed, partially opened, and fully opened orientations. In one embodiment of the invention, the partially opened orientation is opened about 90 degrees relative to the closed orientation and the fully opened orientation is opened about 180 degrees relative to the closed orientation. However, other angular orientations for the partially opened and fully opened orientations are also possible.

Figure 12:
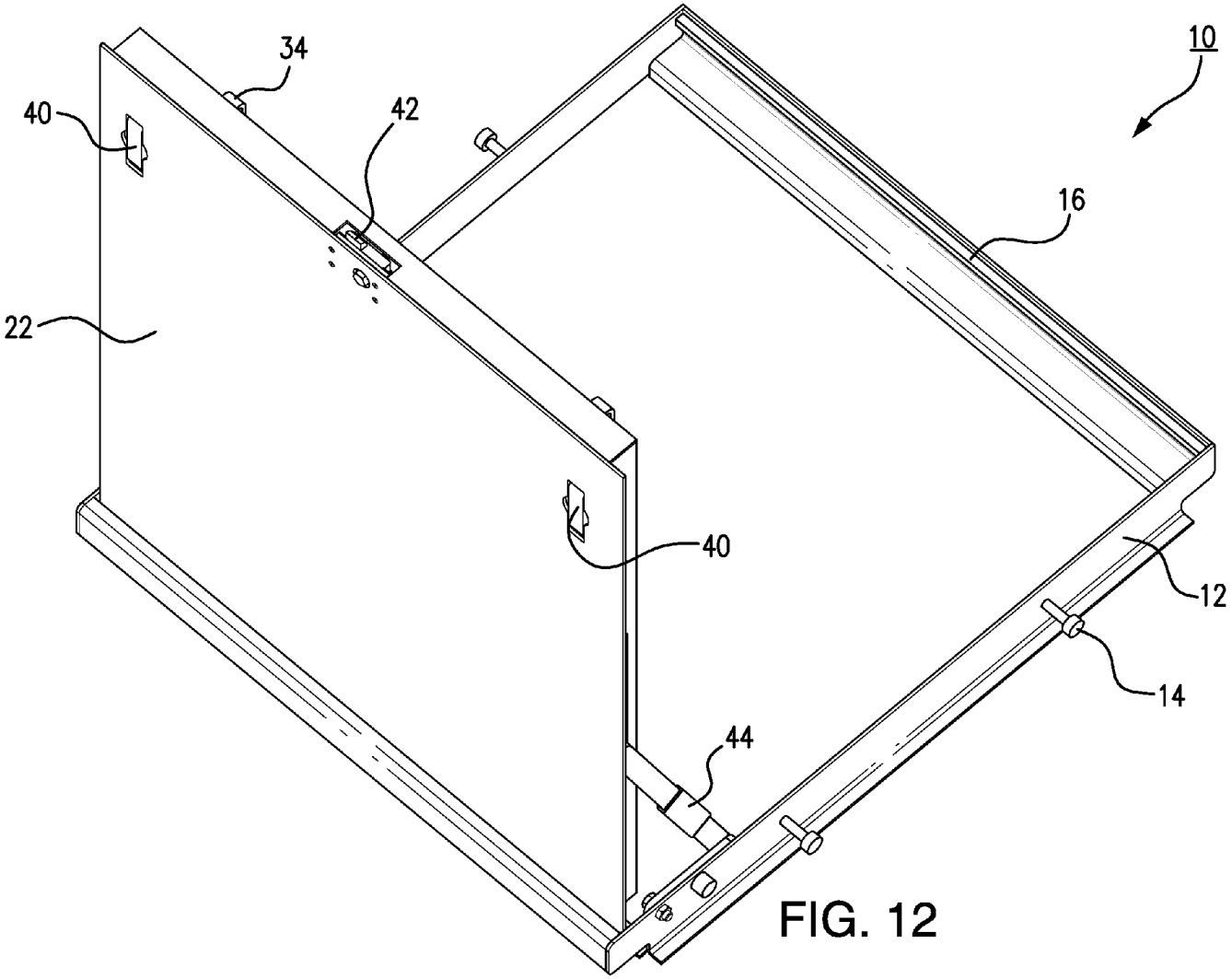
FIG. 12 is a perspective view of the vault door in the partially opened orientation.

The closure includes a rectangular frame 12 having inner and outer peripheral extents and a series of anchor members 14 positioned upon the outer peripheral extent. Also included are a latch receiver 16 (see FIG. 12) and a locking pin receiver 18 (see FIG. 9) formed within the frame 12. In the embodiment of the invention depicted in FIG. 1, the frame 12 is mounted into the ground 20 and defines an access opening for an underground vault. However, embodiments in which the frame 12 is set to any other predetermined mounting location are considered to be within the scope of the present invention.

Figure 3:
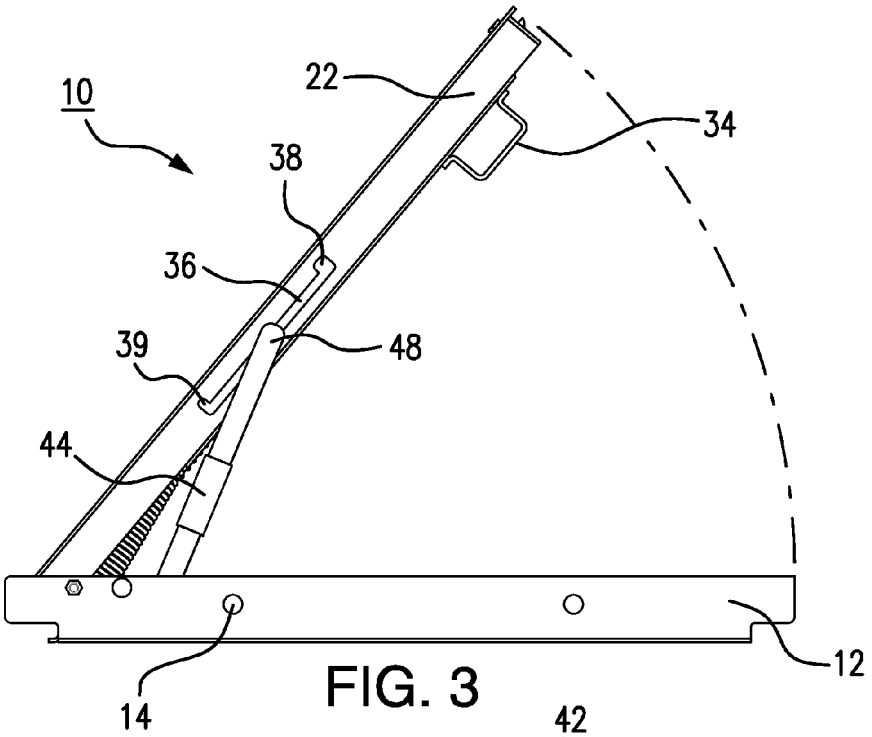
FIG. 3 is a side elevational view of the vault door being opened.
Figure 4:
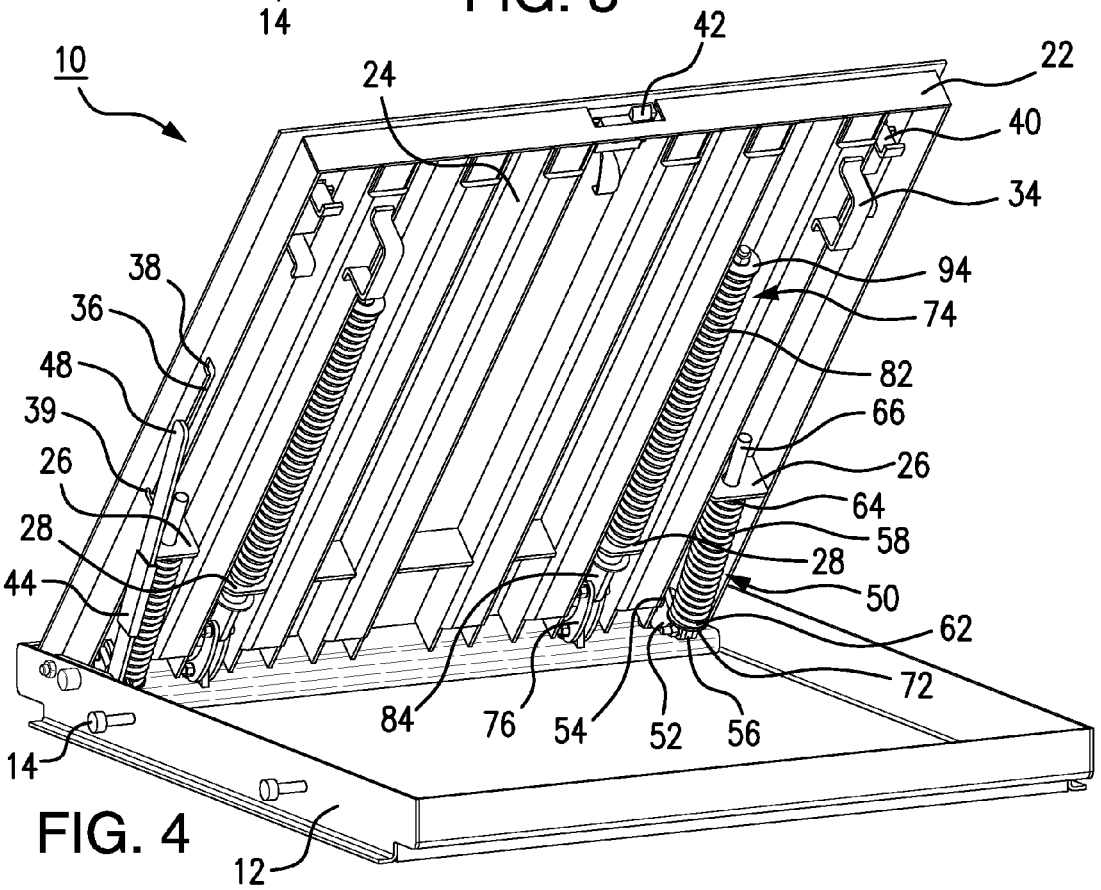
FIG. 4 is a perspective view of the vault door being opened.
Figure 5:
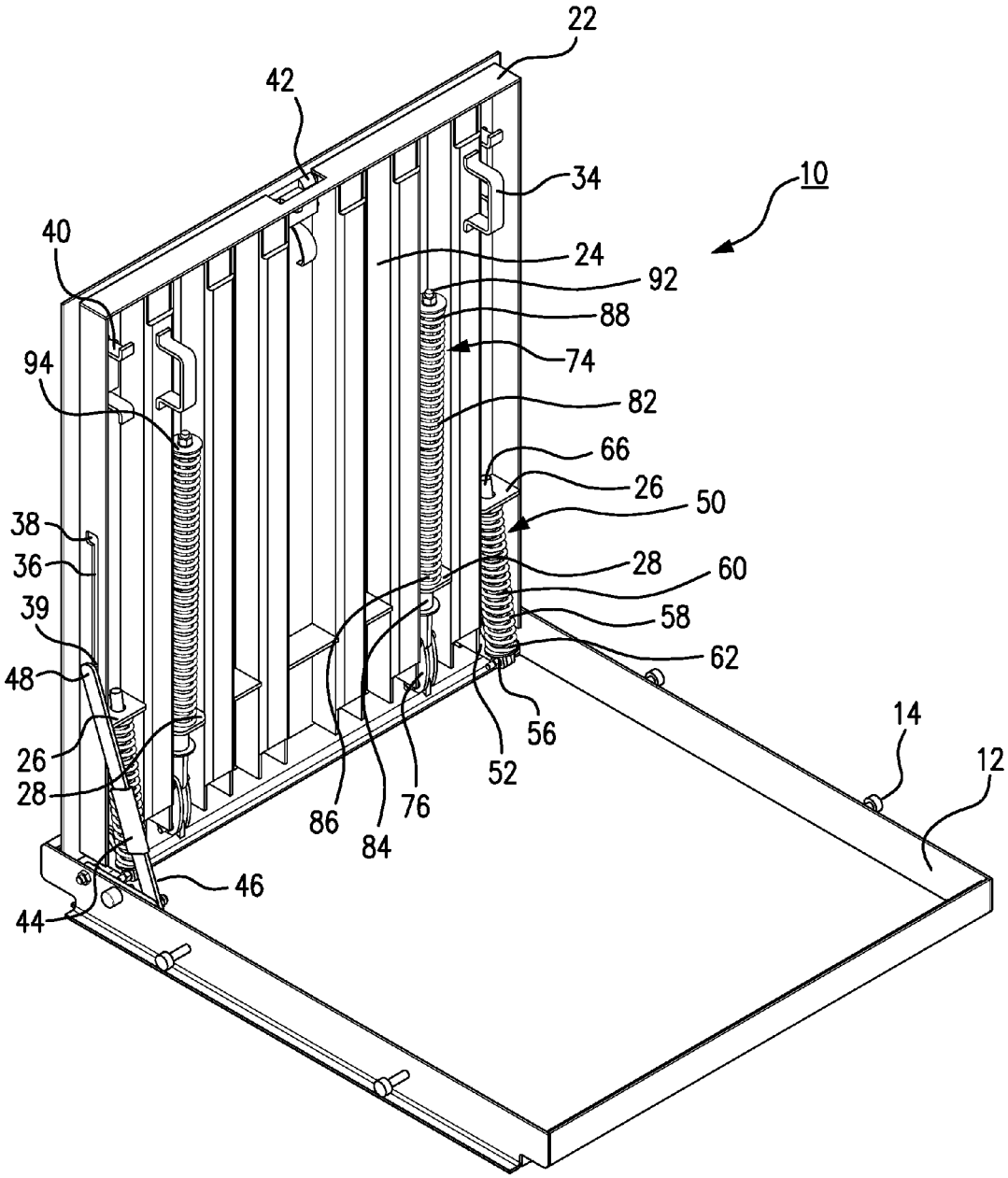
FIG. 5 is a perspective view of the vault door at the 90 degree orientation.
Figure 6:
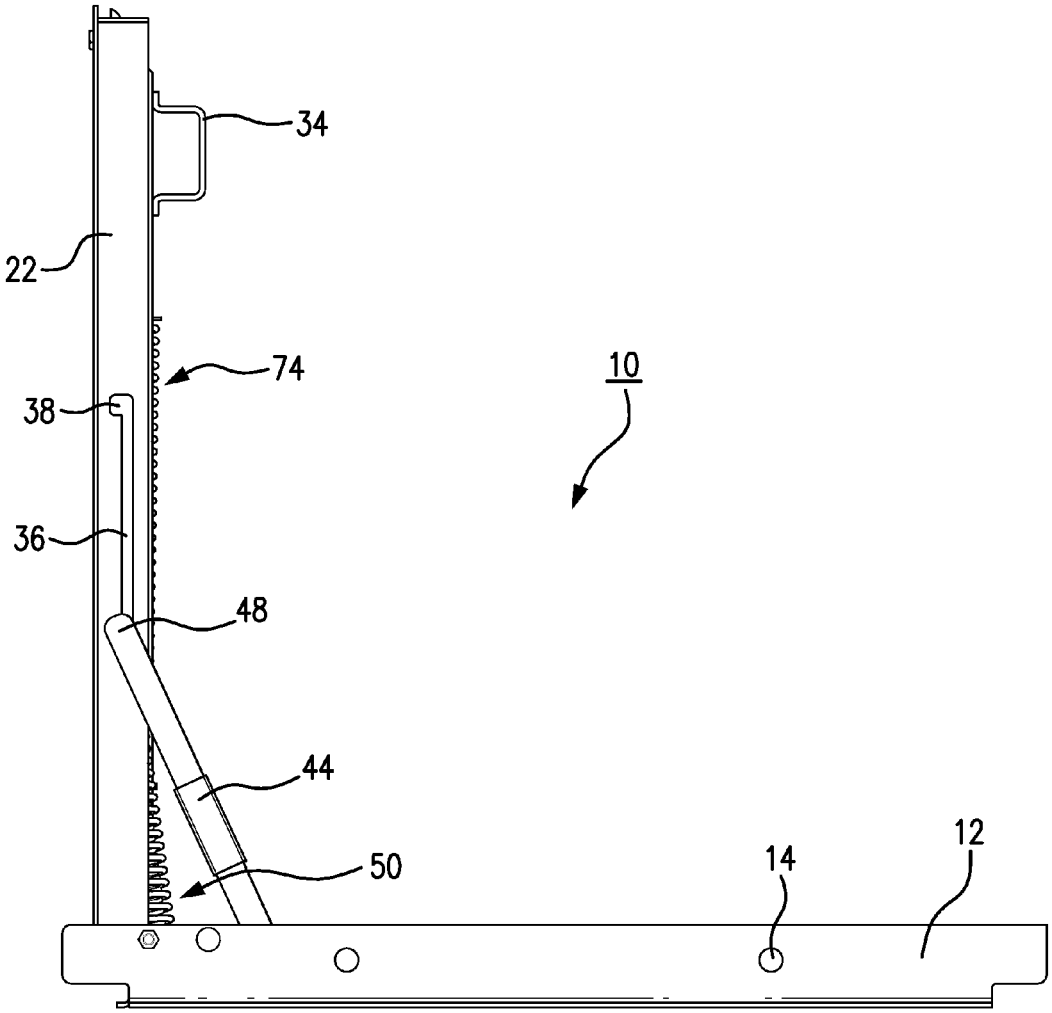
FIG. 6 is a side elevational view of the vault door at the 90 degree orientation.
Figure 7:
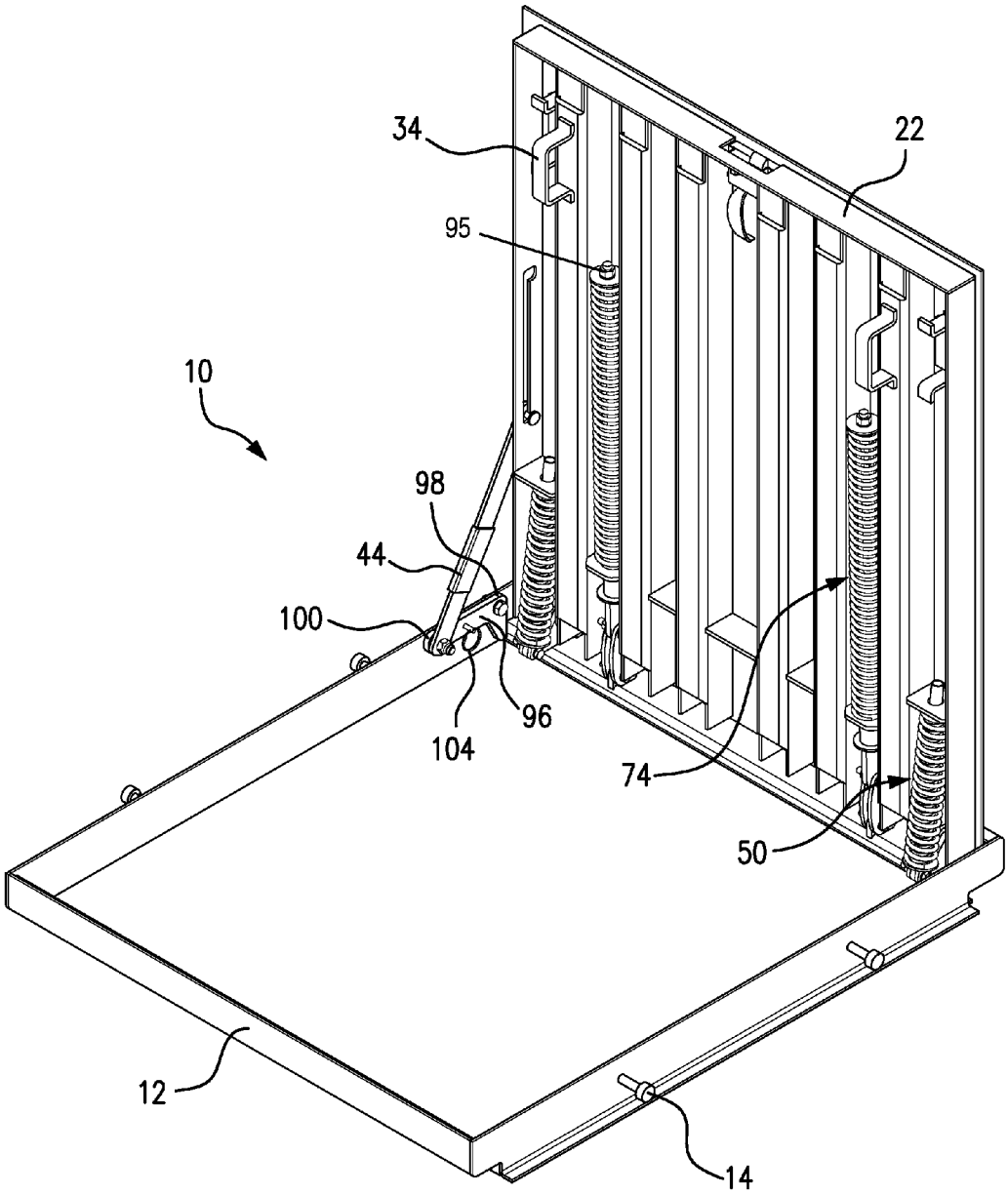
FIG. 7 is a perspective view of the vault door at the 90 degree orientation.

With reference now to FIGS. 2-4, one embodiment of the invention includes a vault door 22 having interior and exterior surfaces and peripheral edges, the interior surface including a plurality of reinforcing ribs 24, a pair of primary apertured compression plates 26 and a pair of secondary apertured compression plates 28. One embodiment of the present invention includes an interior handle 34 for assisting with the movement of the vault door 22 when desirable. Further, a slide 36 with opposing first 38 and second 39 locking detents may be formed within one of the peripheral edges of the vault door 22. As will be described in greater detail hereinafter, the slide 36 enables a user to securely position the vault door 22 in the partially opened orientation as desired.

In one exemplary embodiment of the present invention, the vault door 22 further includes a pair of stowable exterior lifting handles 40 (see FIG. 2) and a male latch 42 (see FIG. 4). The vault door 22 is pivotally connected to the rectangular frame 12. In a closed orientation, the vault door 22 overlies the rectangular frame 12 and the male latch 42 associated with the vault door 22 is received by the latch receiver 16 to lock the vault door 22 and deter access to the underground vault.

Referring now initially to FIGS. 3 and 4, one embodiment of the invention includes a one piece hold-open arm 44 having first 46 and second 48 ends and an intermediate extent therebetween, the second end 48 of the arm being slidably received within the slide 36 and being selectively positionable between the first 38 and second 39 locking detents.

Figure 13:
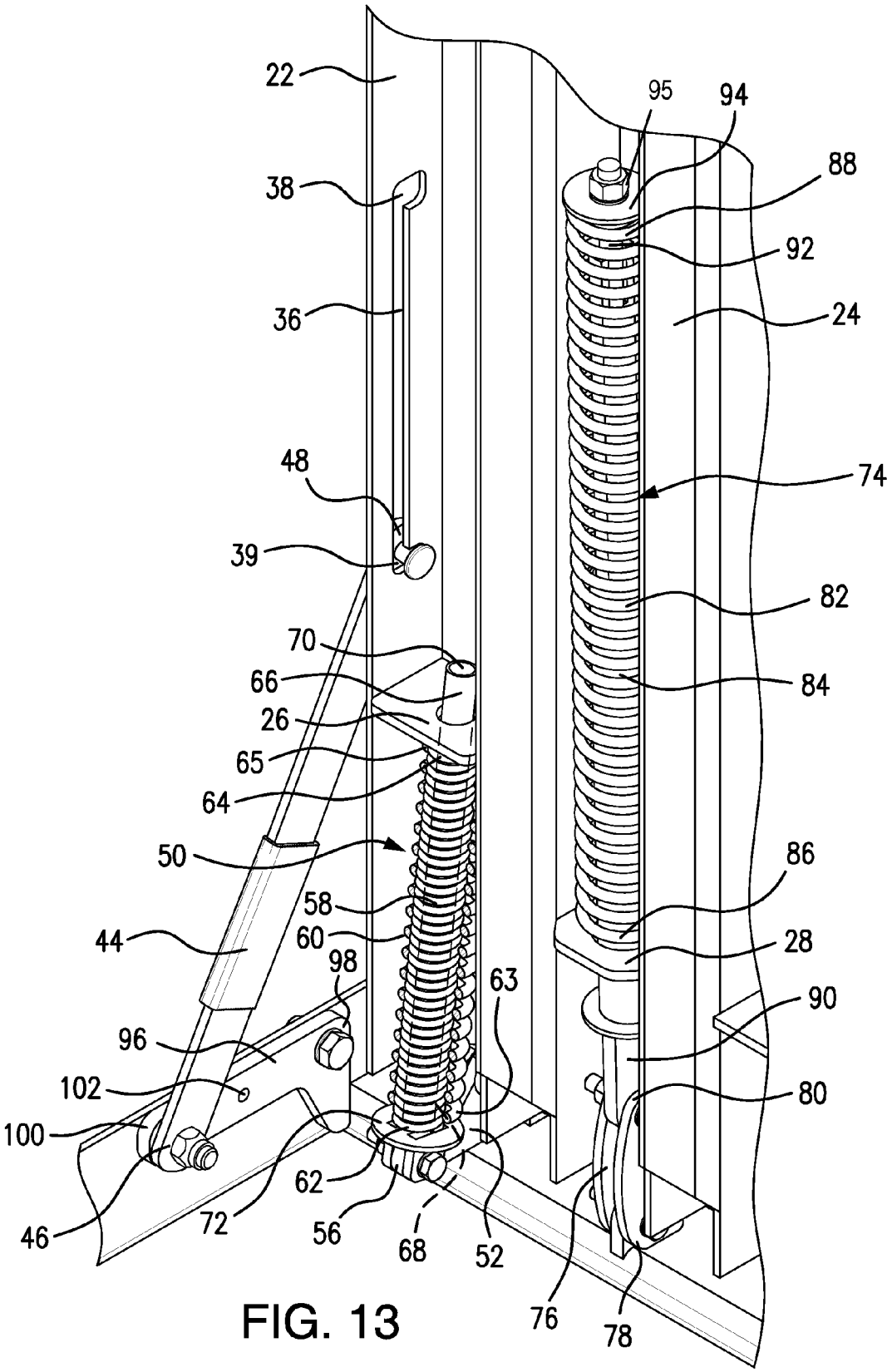
FIG. 13 is a detailed perspective view of the lift assist mechanisms of the present invention.

With continued reference to FIG. 4 and with reference to FIG. 13, an embodiment of the invention disclosed herein includes a pair of primary compression spring lift-assist mechanisms 50, each primary mechanism including a pivotal hinge 52 having first 54 and second 56 ends and first and second orientations. When the door 22 is in either the closed or partially opened orientation, the pivotal hinge 52 is in the first orientation, the first orientation of the pivotal hinge 52 being substantially parallel to the peripheral extent of the frame 12. When the door 22 is in the fully opened orientation, the pivotal hinge 52 is in the second orientation, the second orientation of the pivotal hinge 52 being rotated about 90 degrees relative to the first orientation and substantially perpendicular to the peripheral extent of the frame 12. The first end 54 of each pivotal hinge 52 is fixedly connected to the vault door 22.

In one embodiment of the invention described herein, each primary mechanism 50 further includes first 58 and second 60 compression springs. Each first compression spring 58 includes a first end 62 and a second end 64. Likewise, each second compression spring 60 includes a first end 63 and a second end 65. Each spring has both compressed and decompressed orientations, and the second spring 60 positioned substantially within the first spring 58. The use of two springs in the primary mechanism permits a fine adjustment of the force provided to assist the opening of the vault door, as well as to prevent slamming.

Extending axially through each first 58 and second 60 compression spring is a first support rod 66 having opposing first 68 and second 70 ends. The first end 60 of each support rod 66 further includes a primary compression washer 72. Further, the first end 68 of each first support rod 66 is pivotally connected to the second end 56 of the pivotal hinge 52 and the second end 70 of each first support rod 66 is slidably positioned within an aperture of a corresponding primary apertured compression plate 26. By being slidably positioned within an aperture of a corresponding primary apertured compression plate 26, each first support rod 66 is not only held in a desirable position relative to the other components of the invention, but also permitted to slide forward or backward through the apertured compression plates upon a changing of the orientation of the vault door 22.

The first ends 62 of each first 58 and second 60 spring are positioned against the primary compression washer 72 of the corresponding first support rods 66 and the second ends of each first 58 and second 60 spring are positioned against the corresponding primary apertured compression plate 26 receiving the first support rod 66. This particular positioning of the first and second springs provides a pair of corresponding surfaces for each spring to be either compressed or decompressed against when changing the orientation of the vault door 22, and provides lifting assistance between the closed and partially opened orientations.

One embodiment of the present invention (FIG. 13) also includes a pair of secondary compression spring lift-assist mechanisms 74 for providing lift assistance between the partially opened and fully opened orientations, each secondary mechanism 74 including a connector hinge 76, each connector hinge 76 having first 78 and second 80 ends and first and second orientations. In the first orientation, the connector hinge 76 is substantially parallel to the peripheral extents of the frame 12. In the second orientation, the connector hinge 76 is rotated approximately 90 degrees and thus substantially perpendicular to the peripheral extents of the frame 12. The first end 78 of each connector hinge 76 is pivotally connected to the frame 12.

Also included as part of each secondary lift assist mechanism 74 is a third spring 82 and a second support rod 84 positioned axially therethrough. Each third spring 82 has a first 86 and a second end 88 and compressed and decompressed orientations, and each second support rod 84 has opposing first 90 and second 92 ends. The first end 90 of each second rod 84 is pivotally connected to the second end 80 of the connector hinge 76. A secondary compression washer 94 is connected to the second end 92 of each second rod 84. In one embodiment of the invention, each secondary compression washer 94 is connected to the second end 92 of a corresponding second rod 84 by an end cap 95. The end cap 95 may be threadably secured to a second end 92, and may comprise a nut. Accordingly, by turning the end cap either clockwise or counter-clockwise, the distance between the secondary compression washer 94 and the secondary apertured compression plate 28 may be increased or decreased as desired. This increase or decrease in the distance between the secondary compression washer 94 and the secondary apertured compression plate 28 subsequently either increases or decreases the compression of the third spring 82, thereby permitting an adjustment of the lift-assist force applied by the third spring 82. Further, each second rod 84 is slidably positioned in an aperture of a corresponding secondary apertured compression plate 28, thereby maintaining each third spring 82 and each second support rod 84 and a desirable orientation relative to the other components of the present invention and providing a surface upon which the third spring 82 may be compressed or decompressed, depending of the orientation of the vault door 12. Thus, the first end 86 of each third spring 82 is positioned against the corresponding secondary apertured compression plate 28 and the second end 88 of each third spring 82 is positioned against a secondary compression washer 94, thereby providing two surfaces between which the third spring 82 is either compressed or decompressed, depending on the orientation of the vault door 12.

Figure 10:
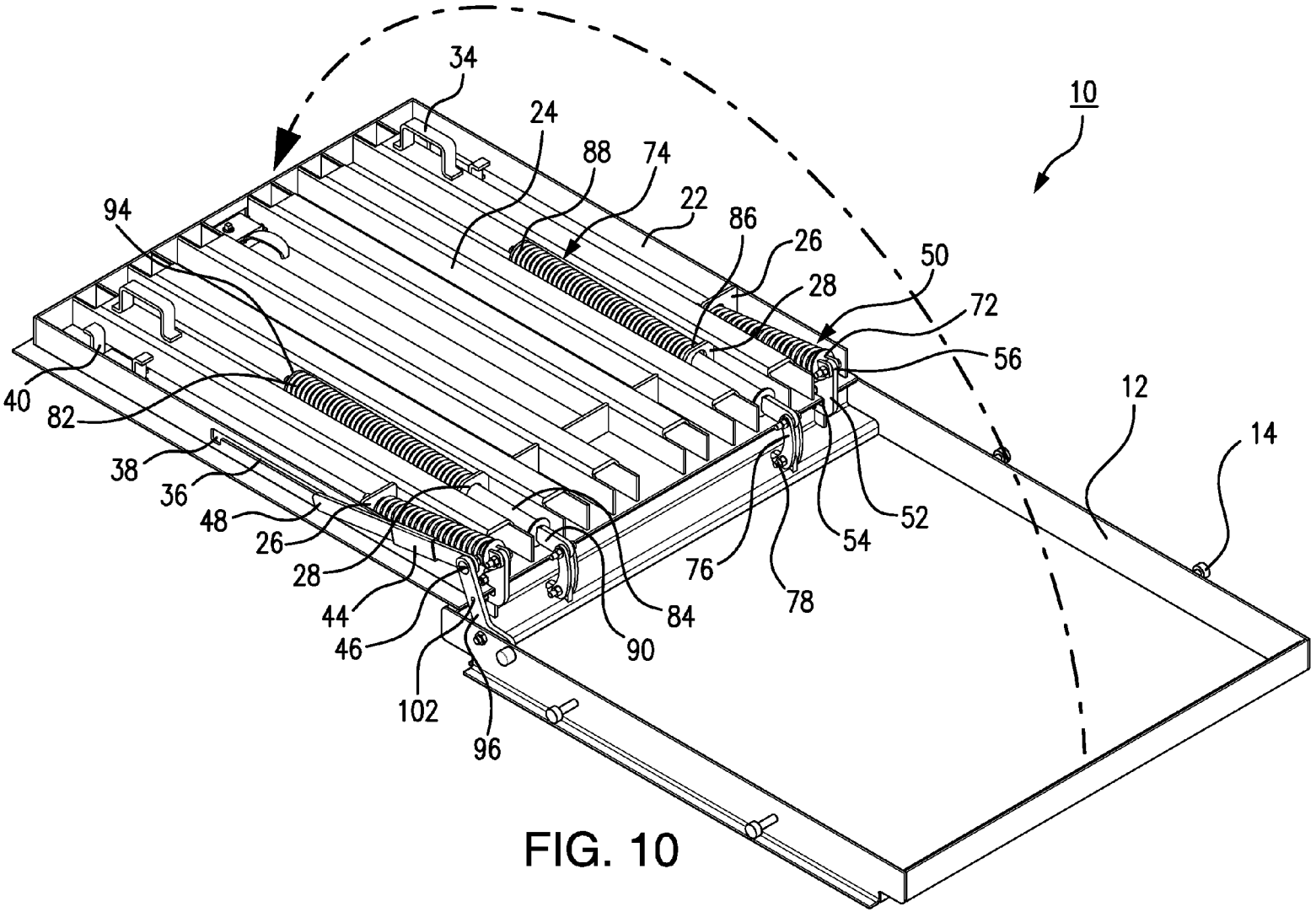
FIG. 10 is a perspective view of the vault door at the 180 degree orientation.
Figure 11:
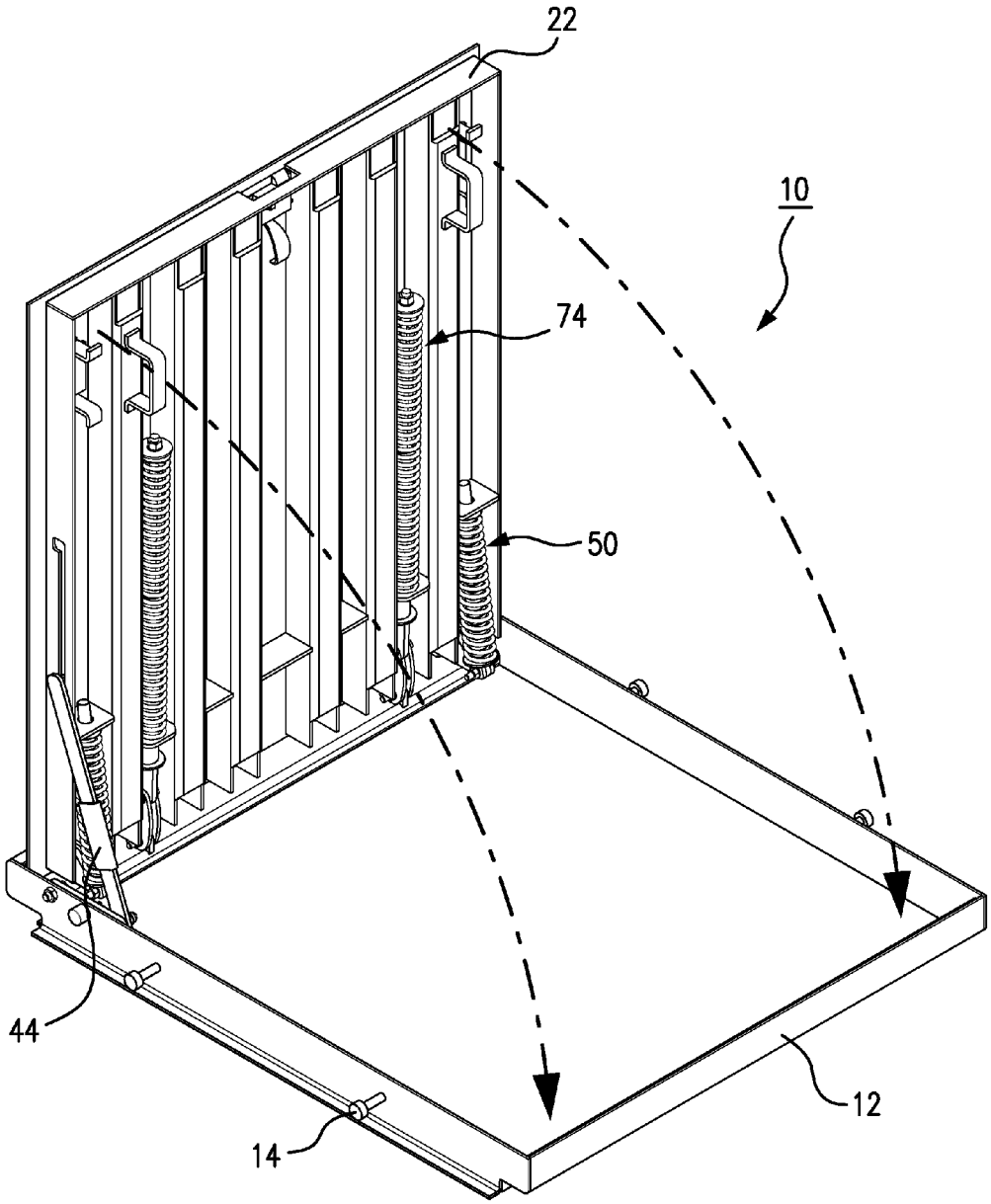
FIG. 11 is a perspective view of the vault door being closed.

With the door 22 in the closed orientation, the connector hinge 76 and the second support rod 84 are substantially in linear alignment. As the door is opened from the closed orientation to the partially opened orientation, the connector hinge 76 and the second support rod 84 remain in linear alignment as their respective angles increase from about 0 to about 90 degrees relative to the frame 12. As the door 22 is further opened from the partially opened orientation to the fully opened orientation, the connector hinge 76 remains substantially stationary at about 90 degrees relative to the frame 12 and the angle of the second rod 84 increases from about 90 to about 180 degrees relative to the frame 12. Accordingly, when the door 22 is positioned in the fully opened orientation, the connector hinge 76 and the second support rod 84 are substantially perpendicular. Because the connector hinge 76 remains stationary as the door 22 door travels between the partially opened and fully opened orientations, the distance between the corresponding secondary apertured compression plate 28 and the first end 90 of the second support rod 84 increases, which subsequently compresses the corresponding third spring 82 (see FIG. 10). This compression of the third spring 82 counters the force of gravity against the door, thereby easing the opening of the door 22 to the fully opened orientation and preventing slamming. Conversely, decompression of the third spring 82 when positioning between the about 180 degree, or fully opened, and about 90 degree, or partially opened, orientations also counters the force of gravity on the vault door, thereby assisting a user in lifting the door from the fully opened orientation to the partially opened orientation.

As will be appreciated by one of ordinary skill in the art, doors of different weights may require different combinations of first, second, and third springs in order to provide the force necessary to achieve the desired lift-assist ratio. For example, heavier doors may require a combination of springs that provide a greater force relative to that required to accommodate a lighter door. Further, the selection of the desired springs may be dictated by the size of the door provided.

The springs utilized may be selected from any number of commercially available springs. For example, the first spring 58 may be selected from a group including but not limited to regular springs, which are smaller and operate on a lower range of forces. There are at least five regular types of springs, which are designated small, medium, large, x-large, and xx-large. The second spring 60 may be selected from a group including but not limited to springs with ¼, 5/16, and 11/32 coil diameters that are more rigid (i.e. stronger or capable of resisting or providing a greater force) than the regular springs. For example, an embodiment using 3 small springs, 2 medium springs and 1 large spring, where the collective strength of the springs lifts the cover by providing specific value, or force, of lift assist, may be provided.

It will also be appreciated by one of ordinary skill in the art that lift-assist mechanisms using other known force generating or resisting devices may be readily substituted for the spring-based mechanisms described herein. For example, a lift-assist mechanism utilizing hydraulic cylinders, pneumatic cylinders, tension springs, and the like may be readily interchangeable and thus are considered to be within the scope of the present invention.

Figure 8:
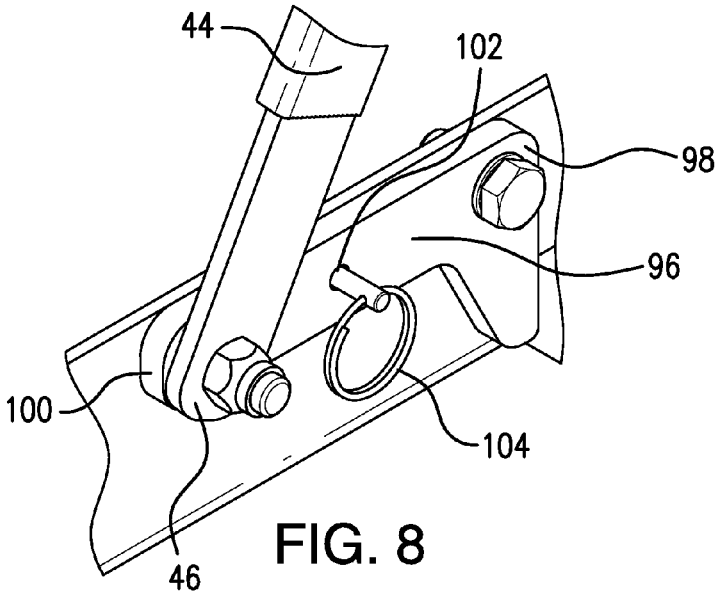
FIG. 8 is a detailed view of the locking mechanism with the hinge plate locked.
Figure 9:
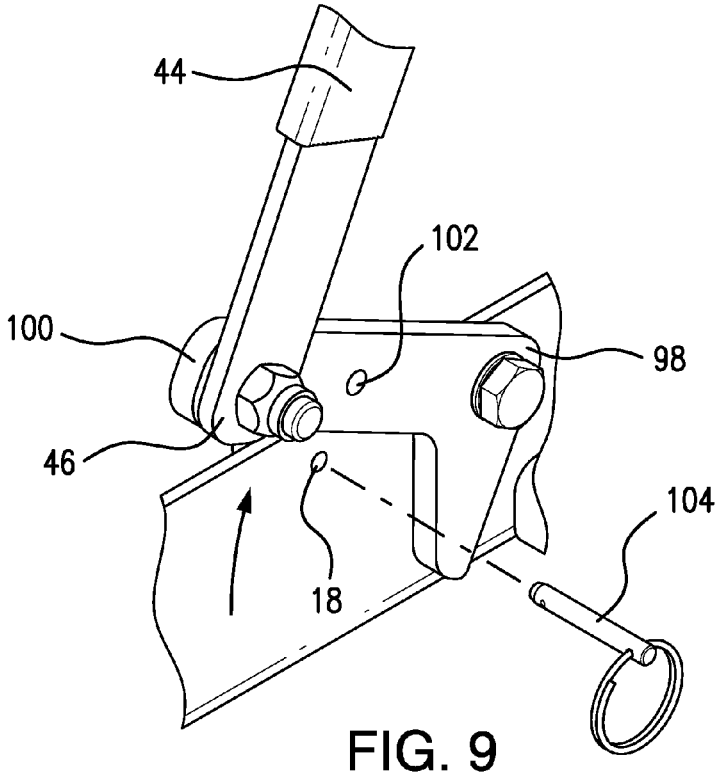
FIG. 9 is a detailed view of the locking mechanism with the hinge plate unlocked.

With reference now to FIGS. 8 and 9, one embodiment of the invention provided herein may further include a hinge plate 96 having a first end 98 rotatably secured to the frame 12 and a second end 100 rotatably secured to the first end 46 of the hold-open arm 44. The hinge plate includes an aperture 102 for receiving a locking pin 104, enabling the locking of the hinge plate 96 in a first orientation substantially parallel to the peripheral extent of the frame 12. The hinge plate pivots between the first orientation parallel to the frame and a second orientation rotated about 90 degrees relative to the frame. The inclusion of the hinge plate as herein described permits the selective positioning of the vault door 22 in the partially opened orientation. Removal of the locking pin 104 permits the vault door 22 to achieve the fully opened orientation.

In use, the vault door 22 is in the closed orientation with the hinge plate 96 in the first orientation, each pivotal hinge 52 in the first orientation, each connector hinge 76 in the first orientation, each first 58 and second 60 spring in the compressed orientation, each third spring 82 in the decompressed orientation, the second end 48 of the hold-open arm 44 adjacent to the first detent 38, and the locking pin 104 positioned through the aperture 102 and into the locking pin receiver 18 in the inner peripheral extent of the rectangular frame 12.

The vault door 22 is in the partially opened orientation with the hinge plate 96 in the first orientation, each pivotal hinge 52 in the first orientation, each connector hinge 76 in the second orientation, each first 58 and second 60 spring in the decompressed orientation, each third spring 82 in the decompressed orientation, the second end 48 of the hold-open arm 44 in the second detent 39, and the locking pin 104 positioned through the aperture 102 and into the locking pin receiver 18 in the inner peripheral extent of the rectangular frame 12.

Removal of the locking pin 104 permits the vault door 22 to achieve the fully opened orientation with the hinge plate 96 in the second orientation, each pivotal hinge 52 in the second orientation, each connector hinge 76 in the second position, each first 58 and second 60 spring in the decompressed orientation, each third spring 82 in the compressed orientation, and the second end 48 of the hold-open arm 44 in the second detent 39.

Although this disclosure has been described in terms of certain embodiments and generally associated methods, alterations and permutations of these embodiments and methods will be apparent to those skilled in the art. Accordingly, the above description of example embodiments does not constrain this disclosure. Other changes, substitutions, and alterations are also possible without departing from the spirit and scope of this disclosure.

What is claimed is:

1. A ground mounted vault closure assembly selectively positionable between closed, partially opened, and fully opened orientations, the closure comprising:

a rectangular frame having inner and outer peripheral extents, a series of anchoring members positioned upon the outer peripheral extent, a latch receiver and a locking pin receiver formed within the frame, the frame being set onto a predetermined mounting location and defining an access opening for an underground vault;

a vault door having interior and exterior surfaces and peripheral edges, the interior surface including a plurality of reinforcing ribs, a pair of primary apertured compressions plates, a pair of secondary apertured compression plates, and at least one interior handle, a slide with opposing first and second locking detents formed within one of the peripheral edges, the vault door further including a pair of stowable exterior lifting handles and a male latch, the vault door being pivotally connected to the rectangular frame and having a closed orientation overlying the rectangular frame, and wherein the male latch is receivable by the latch receiver to lock the door and deter access to the underground vault;

a one piece hold-open arm having first and second ends and an intermediate extent therebetween, the second end of the arm being slidably received within the slide and being selectively positionable between the first and second locking detents;

a pair of primary compression spring lift-assist mechanisms, each primary mechanism including a pivotal hinge, each pivotal hinge having first and second ends and first and second orientations, the first end of each pivotal hinge fixedly connected to the vault door, a first compression spring and a second compression spring, the first and second springs each having first and second ends and compressed and decompressed orientations, the second spring positioned substantially within the first spring, a first support rod having opposing first and second ends and axially positioned through the first and second springs, the first end of the support rod further comprising a primary compression washer and being pivotally connected to the second end of the pivotal hinge, the second end of the support rod being slidably positioned within the aperture of a corresponding primary apertured compression plate, the first ends of the first and second springs positioned against the primary compression washer and the second ends of the first and second springs positioned against the corresponding primary apertured compression plate receiving the first support rod;

a pair of secondary compression spring lift-assist mechanisms, each secondary mechanism including a connector hinge, each connector hinge having first and second ends and first and second orientations, the first end of each connector hinge pivotally connected to the frame, a third spring and a second support rod positioned axially therethrough, each third spring having first and second ends and compressed and decompressed orientations, each second support rod having opposing first and second ends, the first end of each second rod pivotally connected to the second end of the corresponding connector hinge, a secondary compression washer connected to the second end of each second support rod, each second support rod being slidably positioned within the aperture of a corresponding secondary apertured compression plate, the first end of each third spring positioned against the corresponding secondary apertured compression plate and the second end of each third spring positioned against the secondary compression washer; and a hinge plate having a first end rotatably secured to the frame, a second end rotatably secured to the first end of the hold-open arm, and an aperture for receiving a locking pin, the hinge plate pivoting between a first orientation parallel to the frame and a second orientation rotated about 90 degrees relative to the frame;

wherein the door is in the closed orientation with each first and second spring in the compressed orientation and each third spring in the decompressed orientation, the door is in the partially opened orientation with each first and second spring in the decompressed orientation and each third spring in the decompressed orientation, and the door is in the fully opened orientation with each first and second spring are in the decompressed orientation and each third spring in the compressed orientation.

2. A ground mounted vault closure assembly selectively positionable between closed, partially opened, and fully opened orientations, the closure comprising:

a frame having inner and outer peripheral extents;

a vault door having interior and exterior surfaces and peripheral edges, the vault door being pivotally connected to the rectangular frame and having a closed orientation overlying the rectangular frame;

at least one primary compression spring lift-assist mechanism operable for assisting a positioning between closed and partially open orientations; and at least one secondary compression spring lift-assist mechanism operable for assisting a positioning between the partially opened and fully opened orientations;

a slide for selectively holding the vault door in the partially opened orientation, the slide comprising opposing first and second locking detents, a one piece hold-open arm having first and second ends and an intermediate extent therebetween, the second end of the arm being slidably received within the slide and being selectively positionable between the first and second locking detents.

3. The closure as described in claim 2, further comprising a hinge plate for enabling the selective positioning of the vault door between the partially opened and fully opened orientations, the hinge plate being operable with the hold-open arm and having a first end rotatably secured to the frame and an aperture for receiving a locking pin, the hinge plate pivoting between a first orientation parallel to the frame and a second orientation rotated about 90 degrees relative to the frame.

4. A ground mounted vault closure assembly selectively positionable between closed, partially opened, and fully opened orientations, the closure comprising:

a frame having inner and outer peripheral extents;

a vault door having interior and exterior surfaces and peripheral edges, the vault door being pivotally connected to the rectangular frame and having a closed orientation overlying the rectangular frame;

at least one primary compression spring lift-assist mechanism operable for assisting a positioning between closed and partially open orientations; and at least one secondary compression spring lift-assist mechanism operable for assisting a positioning between the partially opened and fully opened orientations;

the at least one primary mechanism including a pivotal hinge fixedly connected to at least one of the frame and the vault door, a first compression spring having compressed and decompressed orientations, and a first support rod axially positioned through the first spring, the first end of the support rod further comprising a compression plate and being pivotally connected to the pivotal hinge.

5. The closure as described in claim 4, the at least one primary mechanism further comprising a second compression spring.

6. The closure as described in claim 5, the second spring positioned substantially within the first spring.

7. The closure as described in claim 6, wherein the door is in the closed orientation with each first and second spring in the compressed orientation.

8. The closure as described in claim 7, wherein the door is in the partially opened orientation with each first and second spring in the decompressed orientation.

9. The closure as described in claim 8, wherein the door is in the fully opened position with each first and second spring in the decompressed orientation.

10. A ground mounted vault closure assembly selectively positionable between closed, partially opened, and fully opened orientations, the closure comprising:

a frame having inner and outer peripheral extents;

a vault door having interior and exterior surfaces and peripheral edges, the vault door being pivotally connected to the rectangular frame and having a closed orientation overlying the rectangular frame;

at least one primary compression spring lift-assist mechanism operable for assisting a positioning between closed and partially open orientations; and at least one secondary compression spring lift-assist mechanism operable for assisting a positioning between the partially opened and fully opened orientations;

the at least one secondary mechanism including a connector hinge pivotally connected to at least one of the frame and the door, a third spring and a second support rod positioned axially therethrough, the third spring having compressed and decompressed orientations, the second support rod connected to the connector hinge.

11. The closure as described in claim 10, wherein the door is in the closed orientation with each third spring in the decompressed orientation.

12. The closure as described in claim 11, wherein the door is in the partially opened orientation with each third spring in the decompressed orientation.

13. The closure as described in claim 12, wherein the door is in the fully opened orientation with each third spring in the compressed orientation.

14. A ground mounted vault closure assembly selectively positionable between closed, partially opened, and fully opened orientations comprising:

a frame being set onto a predetermined mounting location and defining an access opening for an underground vault;

a vault door having interior and exterior surfaces and peripheral edges, the vault door being pivotally connected to the rectangular frame and having a closed orientation overlying the rectangular frame;

at least one primary compression spring lift-assist mechanism connected to the vault door and providing a first force for countering a weight of the vault door when positioning between the closed and partially open orientations, the at least one primary mechanism including a first compression spring, the first spring having first and second ends and compressed and decompressed orientations, a first support rod having opposing first and second ends and axially positioned through the first spring, the first end of the support rod further comprising a compression plate;

at least one secondary compression spring lift-assist mechanism operably linking the vault door and the frame and providing a second force for countering the weight of the vault door when positioning between the partially opened and fully opened orientations, the at least one secondary mechanism including a second compression spring, the second spring having first and second ends and compressed and decompressed orientations, a second support rod having opposing first and second ends and axially positioned through the second spring;

wherein the door is in the closed orientation with the first spring in the compressed orientation and the second spring in the decompressed orientation;

wherein the door is in the partially opened orientation with the first spring in the decompressed orientation and the second spring in the decompressed orientation; and wherein the door is in the fully opened orientation with the first spring in the decompressed orientation and the second spring in the compressed orientation.

15. The closure as described in claim 14, further comprising a slide for selectively holding the vault door in the partially opened orientation.

16. The closure as described in claim 15, further comprising a hinge plate operable with the slide for selectively holding the vault door in the partially opened orientation.

* * * * *